US006437747B1

(12) United States Patent
Stoiljkovic et al.

(10) Patent No.: US 6,437,747 B1
(45) Date of Patent: Aug. 20, 2002

(54) TUNABLE PIFA ANTENNA

(75) Inventors: Vladimir Stoiljkovic, Aylesbury; Peter Webster, Milton Keynes; Shanmuganthan Suganthan, North Harrow, all of (GB)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 09/829,357

(22) Filed: Apr. 9, 2001

(51) Int. Cl.[7] ..... H01Q 1/38
(52) U.S. Cl. ..... 343/702; 343/700 MS
(58) Field of Search ..... 343/700 MS, 745, 343/750, 746, 767, 789, 409

(56) References Cited

U.S. PATENT DOCUMENTS

| | | | | | |
|---|---|---|---|---|---|
| 4,821,041 | A | * | 4/1989 | Evans | 343/700 MS |
| 5,757,323 | A | * | 5/1998 | Spencer | 343/700 MS |
| 5,764,190 | A | | 6/1998 | Murch et al. | 343/702 |
| 5,926,139 | A | | 7/1999 | Korisch | 343/702 |
| 5,966,097 | A | | 10/1999 | Fukasawa et al. | 343/700 MS |
| 6,034,636 | A | | 3/2000 | Saitoh | 343/700 MS |

OTHER PUBLICATIONS

"Dual–Frequency Planar Inverted F–Antenna", by Zi Dong Liu, et al., published Oct. 1997 in IEEE Transactions on Antennas and Propagation, vol. 45, No. 10.
"Optimising the Radiation Pattern of Dual–Frequency Inverted–F Planar Antennas", by Pawel Kabacik, et al., publication and date unknown, pp. 655–658.
"The C–Patch: A Small Microstrip Element", by G. Kossiavas, et al., published Dec. 15, 1988, publication unknown.
"Double C–Patch Antennas Having Different Aperture Shapes", by Mohamed Sanad, publication and date unknown, pp. 2116–2119.

* cited by examiner

*Primary Examiner*—Don Wong
*Assistant Examiner*—James Clinger
(74) *Attorney, Agent, or Firm*—Thomte, Mazour & Niebergall; Dennis L. Thomte

(57) ABSTRACT

A tunable PIFA antenna is disclosed for use with wireless communication devices. In three embodiments of the invention, a movable tuning member constructed of a high-dielectric constant material is selectively moved with respect to the feed and shorting pins of the antenna to vary the frequency response of the antenna. In the fourth embodiment, a slot is molded into the frame of the antenna. The size and position of the slot is varied by the molding tool to vary the frequency response of the antenna.

20 Claims, 6 Drawing Sheets

TUNABLE PIFA ANTENNA

BACKGROUND OF THE INVENTION

1. Field of the Invention

The present invention relates to a planar inverted F antenna (PIFA) for wireless communication devices such as wireless modems, cellular telephones, personal digital assistants, etc. More particularly, the present invention relates to the method of mechanically tuning the resonant frequency and/or the antenna input impedance of the antenna.

2. Description of the Related Art

A planar inverted F antenna continues to be used in various wireless communication devices, which are made in different packages using different printed circuit boards (PCBs). This means that the antenna has to be redesigned for every single application, thus reducing the benefits of high-volume manufacturing. However, if there was a way of mechanically tuning the same basic antenna design to the different package/PCB combinations, then that same antenna design could be used in various applications with reduced unit cost of manufacturing it. To the best of applicants' knowledge, no such mechanical tuning mechanisms for PIFA antennas have been proposed so far.

SUMMARY OF THE INVENTION

A method of tuning a PIFA antenna by adjusting the volume and proximity of a dielectric material to the feed and shorting pins and/or capacitive-loading plates of the antenna is described. The present invention permits the antenna to be tuned to suit variations in applications such as where the ground plane varies in size or where there is a frequency shift required due to the different materials used to make the chassis in which the antenna is mounted. In one embodiment of the invention, the PIFA antenna includes a movable tuning member in the form of a selectively rotatable rotor having a semi-circular rotor vane provided thereon. In another embodiment, a selectively movable block or slug is utilized as the movable tuning member. In still another embodiment of the invention, the frame which supports the movable tuning members in the other embodiments has a slot molded thereinto. The size and position of the slot can be altered, thereby providing a range of antennas based on the same patch and mold tool.

IN THE DESCRIPTION OF THE PREFERRED EMBODIMENT

A principal object of the invention is to provide a means of selectively varying or changing the resonant frequency and/or input impedance of an antenna without having to redesign and make a new antenna.

A further object of the invention is to provide a single antenna which can cover a wider frequency range than was previously available.

Still another object of the invention is to provide an antenna wherein it is possible to replace a number of antennas with a single selectively variable design, thereby reducing unit cost in volume manufacturing as well as the antenna design time.

These and other objects will be apparent to those skilled in the art.

DESCRIPTION OF THE PREFERRED EMBODIMENT

Figure 1:
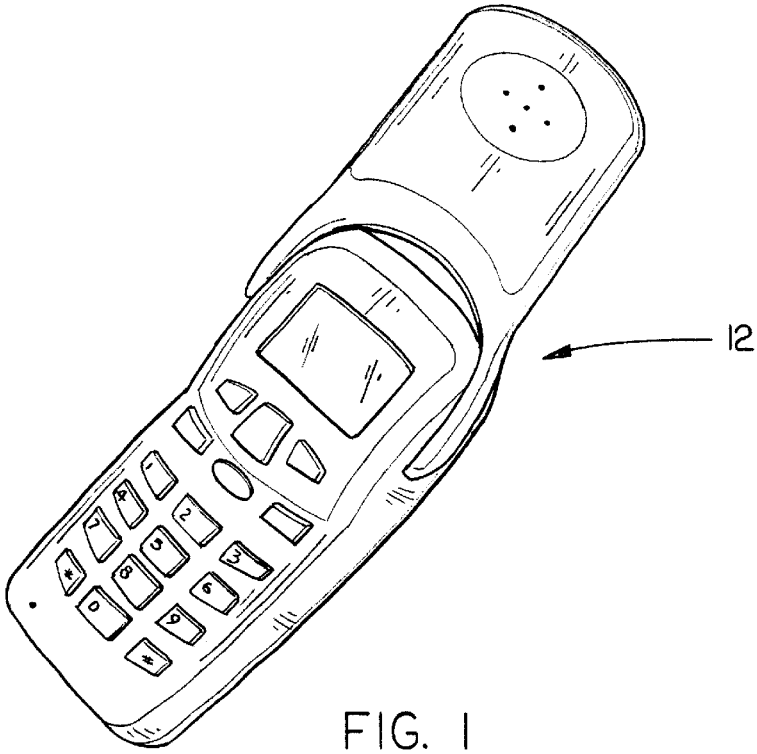
FIG. 1 is a perspective view of a cellular telephone having the tunable PIFA antenna mounted therein.
Figure 2:
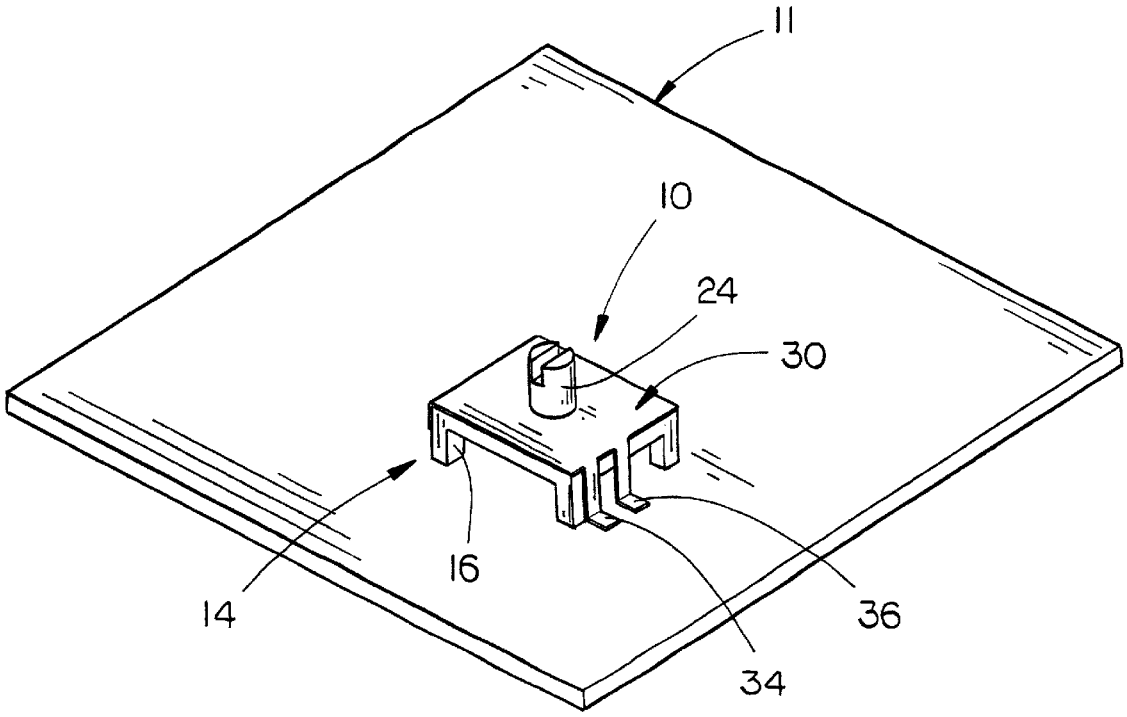
FIG. 2 is a perspective view illustrating the tunable PIFA antenna.

One embodiment of the PIFA antenna is referred to by the reference numeral 10 while other embodiments of the PIFA antenna will be referred to by the reference numerals 10', 10", 10'", and 10"". Inasmuch as antennas 10', 10", 10'", and 10"" are identical to antenna 10 except for the design of the tunable portion of the antenna, only antenna 10 will be described in detail with "", "'", "'"", and "'""", referring to identical structure on antennas 10', 10", 10'", and 10"", respectively.

Figure 3:
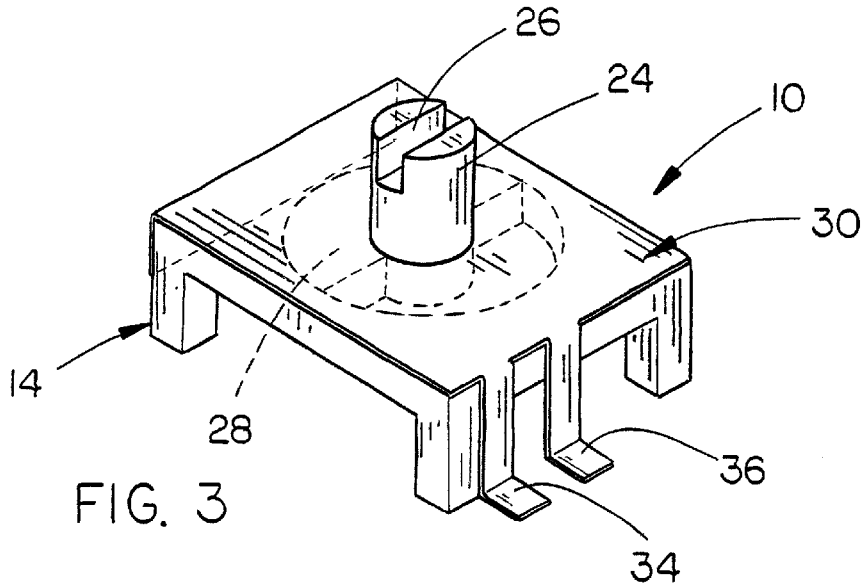
FIG. 3 is a perspective view of the antenna of FIG. 2.
Figure 4:
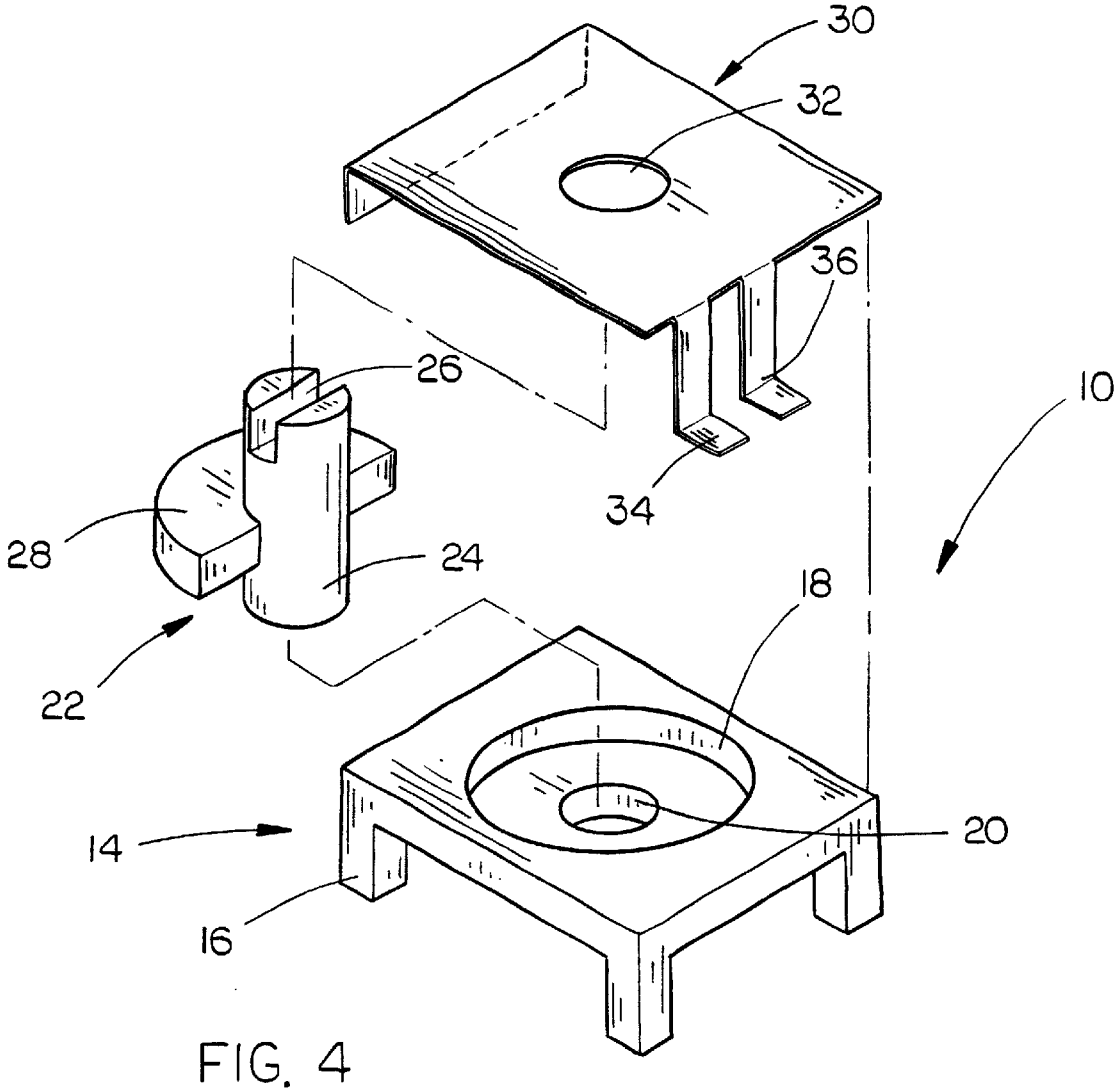
FIG. 4 is an exploded perspective view of the antenna of FIGS. 2 and 3.
Figure 5:
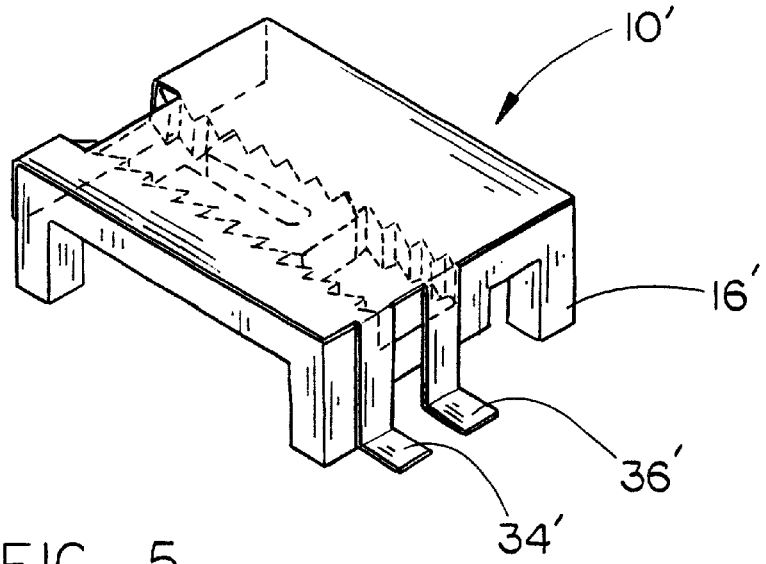
FIG. 5 is a perspective view of a second embodiment of the tunable antenna.
Figure 6:
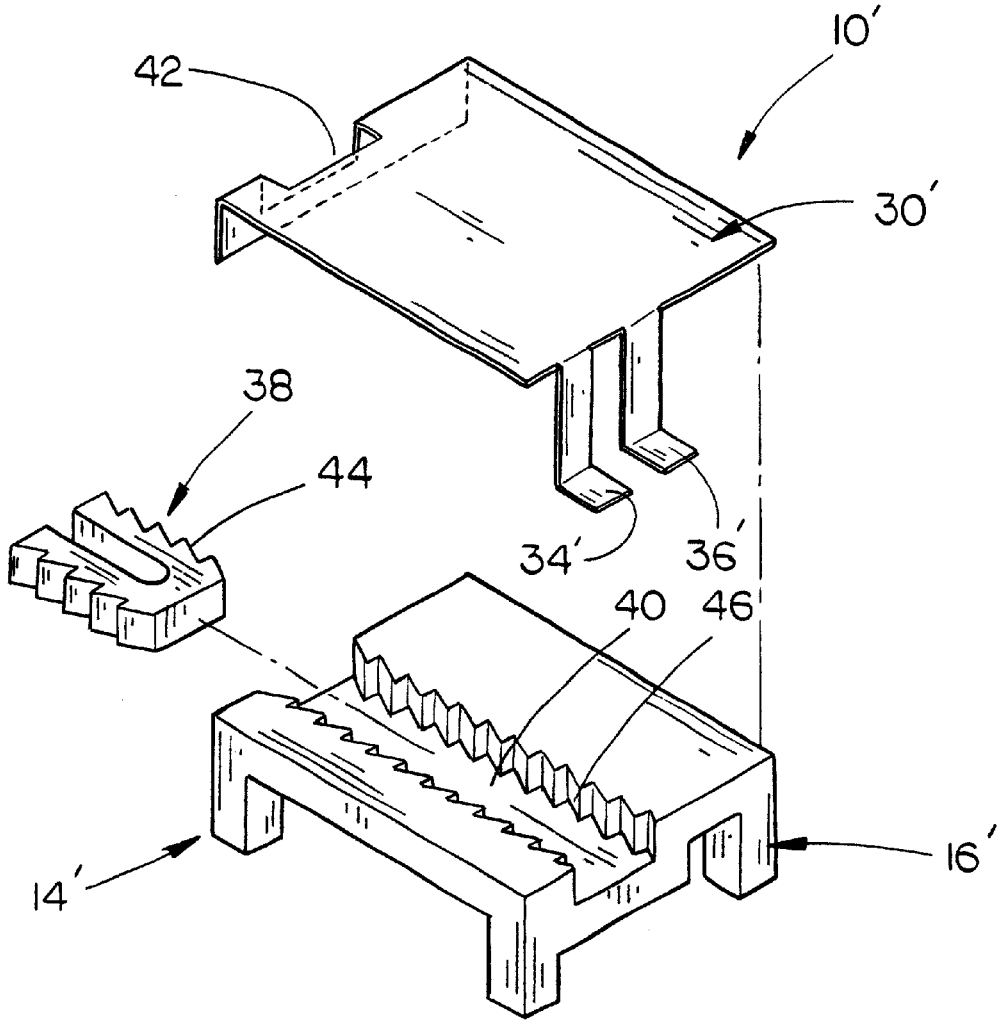
FIG. 6 is an exploded perspective view of the antenna of FIG. 5.
Figure 7:
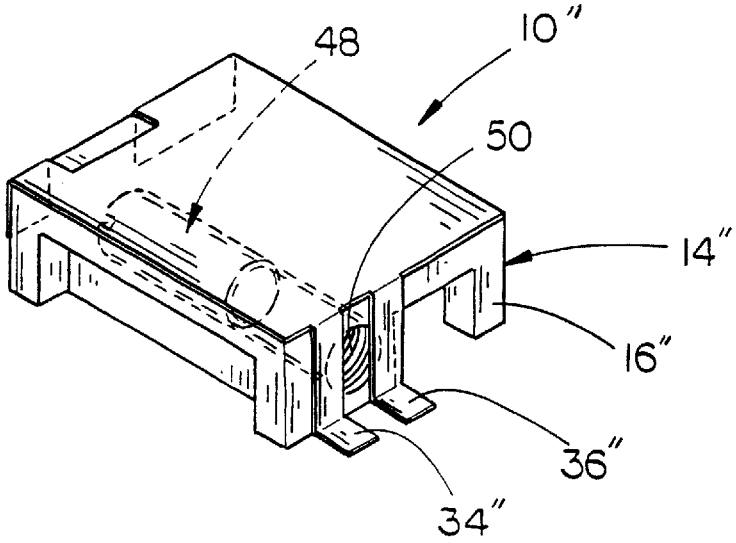
FIG. 7 is a perspective view of a third embodiment of the tunable antenna.
Figure 8:
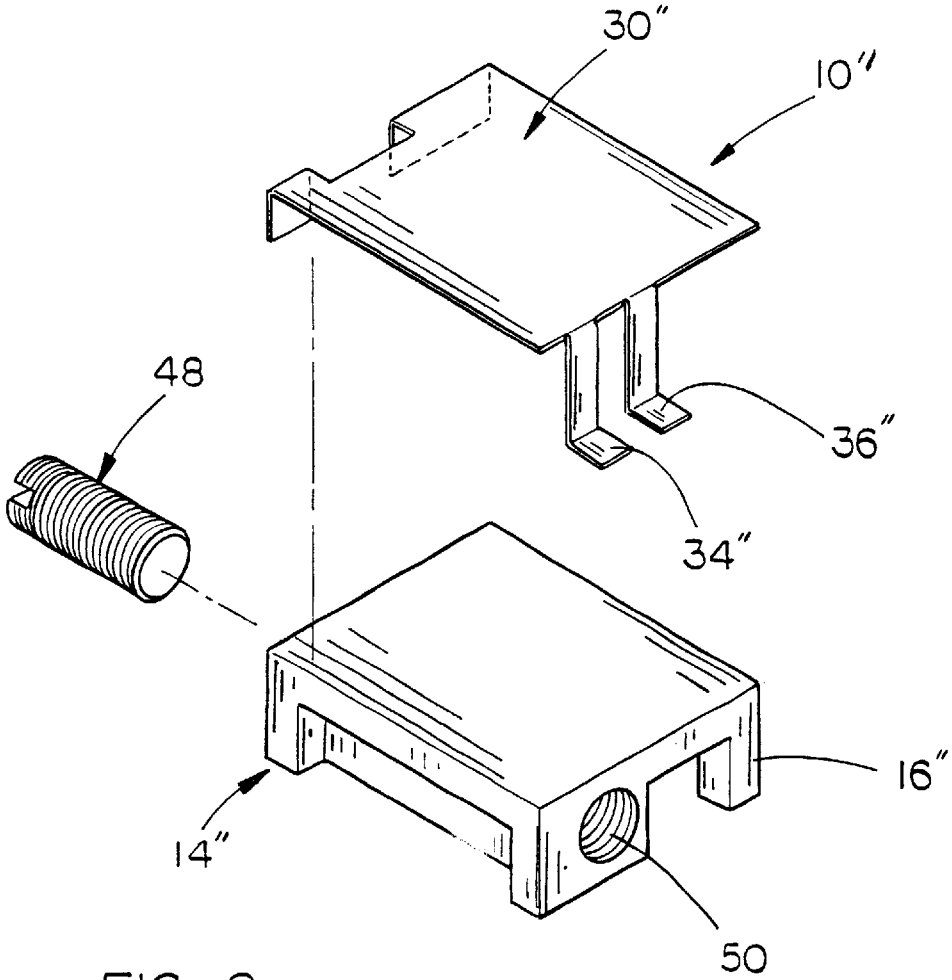
FIG. 8 is an exploded perspective view of the tunable PIFA antenna of FIG. 7.

In the drawings, the numeral 11 refers to the printed circuit board (PCB) in a wireless communication device which may be a cellular telephone, laptop computer, modem, personal digital assistant, etc, which is generally indicated by the reference numeral 12. The PIFA antenna 10 includes a carrier frame 14 having support legs 16 extending therefrom. A circular recess 18 is formed in frame 14 as is a circular opening 20. The numeral 22 refers to a movable tuning member which includes a rotor 24 having a screwdriver slot 26 formed in one end thereof. The other end of rotor 24 is rotatably received by the opening 20, as seen in FIGS. 3 and 4. A semi-circular rotor vane 28 is provided on rotor 24 for rotation therewith. Rotor vane 28 is constructed of a high-dielectric constant material. Patch 30 is positioned over frame 14 so that the end of the rotor 24 having the screwdriver slot 26 formed therein protrudes through opening 32 of patch 30. Patch 30 includes a feed pin 34 and a ground pin 36 which are soldered or otherwise electrically connected to PCB 11 in conventional fashion. Frame 14 is mounted on the PCB 11 by solder, clips, screws, or such other means as may be convenient.

The rotor vane 28 is shaped such that when the rotor 24 is rotated, there is a variation in mass and proximity of dielectric material to the feed pin 34 and ground pin 36. The effect of this variation is to vary the frequency response of the PIFA antenna 10. Thus, PIFA 10 is provided with a way of tuning the resonant frequency and/or the antenna input impedance thereof. The design of PIFA 10 enables the antenna to replace a range of antennas with a single design with the single design having the capability of being selectively adjusted to meet the requirements of a specific design.

PIFA antenna 10' varies somewhat from the design of PIFA antenna 10 in that the movable tuning member 22 of PIFA antenna 10 has been replaced by a selectively slidable toothed block or slug 38. In PIFA 10', the frame 14' has a toothed slot 40 formed therein which communicates with the opening 42 formed in patch 30'. The teeth 44 on block 38 engage the teeth 46 in slot 40 to selectively maintain the block 38 in position. The longitudinal movement of the high-dielectric block 38 with respect to the feed pin 34' and ground pin 36' also provides a way of tuning the resonant frequency and/or the antenna input impedance by varying the volume and proximity of a dielectric material with respect to the feed and shorting pins 34' and 36', respectively.

In the PIFA antenna 10", the movable tuning member is in the form of a threaded plug or screw 48 comprised of a high-dielectric constant material. Plug 48 is threadably received in threaded bore 50 in frame 14". The longitudinal movement of the plug 48 with respect to the feed pin 34" and ground pin 36" provides a way of selectively tuning the resonant frequency and/or the antenna input impedance by varying the volume and proximity of a dielectric material with respect to the feed and shorting pins 34" and 36", respectively.

Figure 9:
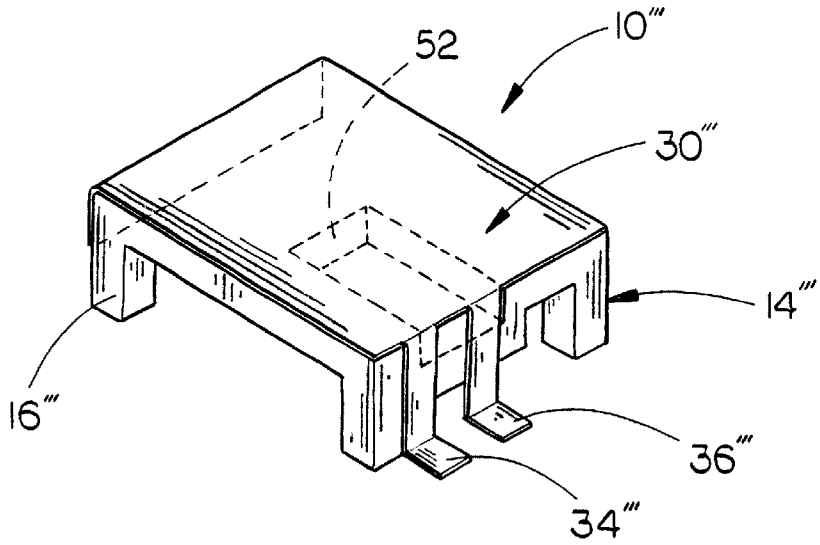
FIG. 9 is a perspective view of a fourth embodiment of the tunable antenna.
Figure 10:
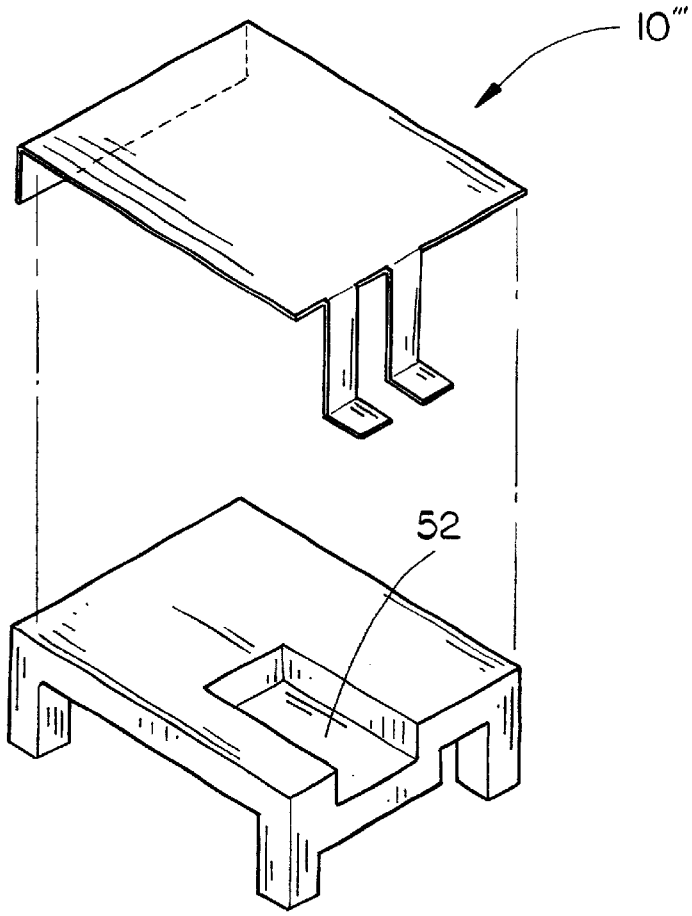
FIG. 10 is an exploded perspective view of the antenna of FIG. 9.

Yet another embodiment of the PIFA antenna is illustrated in FIGS. 9 and 10 and is referred to by the reference numeral 10'''. In PIFA 10''', the frame 14''' is provided with a slot 52 molded thereinto. The molding tool used to mold frame 14''' can be configured so that the size and position of the slot can be altered, thereby providing a range of antennas based on the same patch and mold tool.

Figure 11:
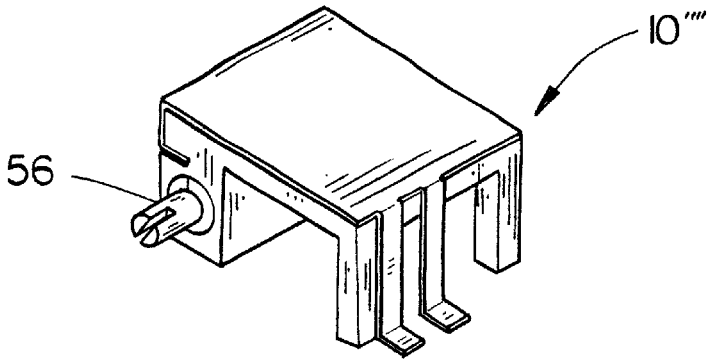
FIG. 11 is a perspective view of a fifth embodiment of the tunable antenna.
Figure 12:
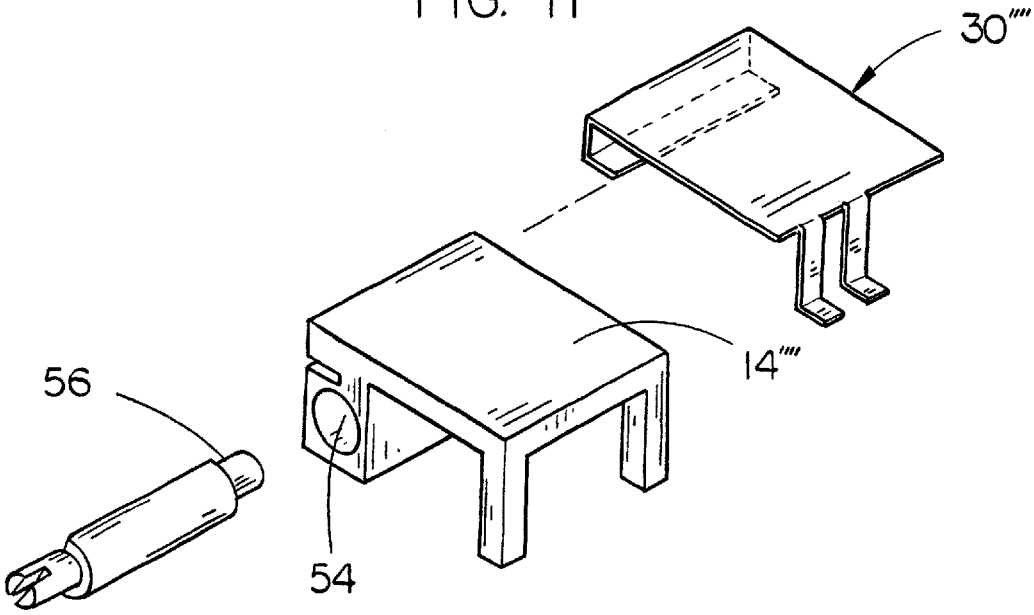
FIG. 12 is an exploded perspective view of the antenna of FIG. 11.
Figure 13:
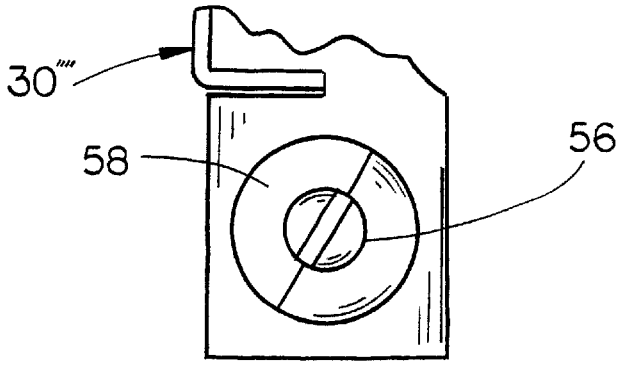
FIG. 13 is a partial side view of the antenna of FIG. 11.

Still another embodiment of the PIFA antenna is illustrated in FIGS. 11–13 and is referred to by the reference numeral 10''''. In PIFA 10'''', the frame 14'''' is provided with a transverse bore 54 formed therein which rotatably receives a transverse rotor 56 which is semi-circular in profile so that the volume of an air gap below the patch 30'''' may be selectively varied as shown. In this way, the PIFA 10'''' is effectively capacitively loaded with a variable capacitor.

In PIFA antennas 10, 10', 10", 10''', and 10'''', the movable tuning members will be formed from a high-dielectric constant material while the remaining components may be constructed of low-dielectric constant materials. In PIFA antennas 10, 10', 10", 10''', and 10'''', it is recommended that the tolerances be such that the movable tuning members will remain in place if the wireless communication device is bumped, dropped, etc. Further, some form of holding members could be employed if needed to maintain the tuning members in place once they have been adjusted.

Thus it can be seen that a novel tunable PIFA antenna has been provided which accomplishes at least all of its stated objectives of the invention.

We claim:

1. A tunable antenna system for a wireless communication device, comprising:

a PIFA antenna including feed and shorting pins;

said PIFA antenna including a tuning member, comprised of a dielectric material, selectively movably mounted thereon which may be selectively moved with respect to said feed and shorting pins.

2. The antenna system of claim 1 wherein said tuning member is comprised of a high-dielectric constant material.

3. The antenna system of claim 2 wherein other parts of said PIFA are comprised of low-dielectric constant materials.

4. The antenna system of claim 1 wherein said tuning member comprises a rotor having a flat, semi-circular rotor vane mounted thereon.

5. The antenna system of claim 4 wherein said rotor vane is comprised of a high-dielectric constant material.

6. The antenna system of claim 1 wherein said tuning member comprises a sliding block which is selectively movable towards said feed and shorting pins and which is selectively movable away from said feed and shorting pins.

7. The antenna system of claim 6 wherein said tuning member comprises a flat slug having means thereon for maintaining said flat slug in a preselected position.

8. The antenna system of claim 1 wherein said tuning member comprises a threaded plug.

9. A tunable antenna system for a wireless communication device, comprising:

a PIFA antenna including feed and shorting pins;

and means for varying the volume and proximity of a dielectric material with respect to said feed and shorting pins.

10. The antenna system of claim 9 wherein said means for varying the volume and proximity of a dielectric material with respect to said feed and shorting pins comprises a selectively rotatable rotor having a flat, semi-circular rotor vane mounted thereon.

11. The antenna system of claim 10 wherein said rotor vane is comprised of a high-dielectric constant material.

12. The antenna system of claim 9 wherein said means for varying the volume and proximity of a dielectric material with respect to said feed and shorting pins comprises a sliding block which is selectively movable towards said feed and shorting pins and which is selectively movable away from said feed and shorting pins.

13. The antenna system of claim 9 wherein said means for varying the volume and proximity of a dielectric material with respect to said feed and shorting pins comprises a flat slug having means thereon for maintaining said flat slug in a preselected position.

14. The antenna system of claim 9 wherein said means for varying the volume and proximity of a dielectric material with respect to said feed and shorting pins comprises a threaded plug.

15. A PIFA antenna for use with a wireless communication device including a printed circuit board (PCB), comprising:

an antenna frame including a base portion spaced from the PCB and having supports extending therefrom for engagement with the PCB;

an antenna patch on said frame which has at least one feed pin and at least one shorting pin extending therefrom for electrical connection to the PCB;

a dielectric tuning member selectively movably mounted on said frame;

said dielectric tuning member being selectively movable with respect to said feed and shorting pins for varying the proximity of said dielectric tuning member with respect to said feed and shorting pins to vary the frequency response of the PIFA antennas.

16. The PIFA antenna of claim 15 wherein said dielectric tuning member is comprised of a high-dielectric constant material and wherein said frame and said patch are comprised of a low-dielectric constant material.

17. The PIFA antenna of claim 15 wherein said dielectric tuning member comprises a rotor vane rotatably mounted on said frame.

18. The PIFA antenna of claim 15 wherein said dielectric tuning member comprises a threaded plug movably mounted on said frame.

19. The PIFA antenna of claim 15 wherein said dielectric tuning member comprises a block movably mounted on said frame.

20. A PIFA antenna for use with a wireless communication device including a printed circuit board (PCB), comprising:

an antenna frame including a base portion spaced from the PCB and having supports extending therefrom for engagement with the PCB;

an antenna patch on said frame which has at least one feed pin and at least one shorting pin extending therefrom for electrical connection to the PCB;

said frame being comprised of a high-dielectric constant material;

said base having a slot formed therein;

said slot being selectively positioned on said frame during the fabrication thereof for varying the position thereof with respect to said feed and shorting pins for varying the frequency response of the PIFA antenna.

* * * * *